US005161786A

United States Patent [19]

Cohen

[11] Patent Number: 5,161,786

[45] Date of Patent: Nov. 10, 1992

[54] PLASTIC STAND PIPE SUPPORT FOR LOAD-BEARING ADJUSTABLE COLUMN

[75] Inventor: Yoav Cohen, Raanana, Israel

[73] Assignee: Fichtel and Sachs Industries, Inc., Colmar, Pa.

[21] Appl. No.: 700,613

[22] Filed: May 15, 1991

[30] Foreign Application Priority Data

May 2, 1991 [IL] Israel ..... 98036

[51] Int. Cl.[5] ..... F16F 5/00

[52] U.S. Cl. ..... 267/64.12; 267/64.11

[58] Field of Search ..... 267/117, 120, 124, 131, 267/64.11-64.13; 188/322.19, 300, 319; 92/165 R, 169.1, 170.1; 138/103, 108, 110, 121; 248/562, 566

[56] References Cited

U.S. PATENT DOCUMENTS

| | | | |
|---|---|---|---|
| 2,391,275 | 12/1945 | Shaw | 267/120 |
| 3,599,956 | 8/1991 | Harder, Jr. | 267/131 |
| 3,790,119 | 2/1974 | Bauer | 248/562 |
| 4,113,220 | 9/1978 | Godwin et al. | 188/300 |
| 4,257,582 | 3/1981 | Wirges | 267/120 |
| 4,445,671 | 5/1984 | Reuschenbach | 267/64.12 |
| 4,569,957 | 2/1986 | Woelfel | 523/500 |
| 4,756,339 | 7/1988 | Buluschek | 138/103 |
| 4,871,149 | 10/1989 | Dony et al. | 267/64.12 |

*Primary Examiner*—Robert J. Oerleitner
*Assistant Examiner*—Chris Schwartz
*Attorney, Agent, or Firm*—Brumbaugh, Graves, Donohue & Raymond

[57] ABSTRACT

A plastic stand pipe designed for application to furniture such as a chair, to replace a metal stand pipe supporting a gas fluid spring which allows a seat to be raised and lowered as desired. The plastic stand pipe is attached to the chair base, and encloses the fluid spring which supports the seat. The inventive design relies on the combination of a novel structural configuration of the stand pipe inner working parts which support the fluid spring cylinder and use of appropriate plastic engineering materials to achieve the result allowing for replacement of the metal stand pipe. The structural configuration features a plurality of ribs formed on the inner wall of a plastic tubular member, such that the ribs contact the fluid spring cylinder and provide circumferential support. The end of each rib is formed with a support projection which is flexible, and the plurality of support projections form a floating support ring allowing for some freedom in the fluid spring movement from side to side at its top end. The design of the interior ribs supplies the dual function of guiding the fluid spring with flexibility while providing sufficient rigidity to support loads placed on it. The plastic engineering material comprises fiberglass-reinforced nylon and a ter polymer comprising ethylene, acrylic acid and maleic anhydride, and provides sufficient strength, flexibility and durability under the severe mechanical conditions of the application.

35 Claims, 5 Drawing Sheets

PLASTIC STAND PIPE SUPPORT FOR LOAD-BEARING ADJUSTABLE COLUMN

FIELD OF THE INVENTION

The present invention relates to structural elements used in construction of furniture including chairs, tables and the like, and more particularly, to a plastic stand pipe support enclosing a load-bearing, adjustable-length fluid spring used to adjust the height or orientation of a seat or other surface.

BACKGROUND OF THE INVENTION

In recent years, the devlopment of plastic engineering materials has progressed to the point where, in many applications, a suitable plastic can be found to replace a metal structural component. Previous to this, plastic materials were generally not strong and versatile enough for such use. If the plastics were strong enough, they were brittle, and if developed to be strong and flexible, they were not durable.

With the development of improved plastic engineering materials, the trend in replacement and redesign using plastic components became noticeable especially in the automotive industry, and also in furniture design. The benefits to be derived from the use of plastic materials include reduced cost and manufacturing time, reduced weight and many other benefits.

Today, plastics such as polyamides, thermoplastic polyester and polycarbonates which can be impact modified, fiberglass reinforced and carbon fiber reinforced, have become suitable for many applications in which metal components were previously used. These applications include those requiring a tensile strength of over 24,100 lbs/sq-in. and an impact strength of over 3–4 lbs/in, and in which the components are required to perform under large amounts of stress for a long period of time.

In many prior art designs of modern office furniture, a gas spring is used in a support column to enable height adjustment of a seat or table surface, and these designs are disclosed in patents such as U.S. Pat. No. 4,113,220 to Collignon et al, U.S. Pat. No. 4,257,582 to Wirges, and U.S. Pat. No. 4,662,681 to Favaretto. Most of these designs use a metal stand pipe which is inserted into the chair base to provide a support column for the fluid spring, although the Favaretto patent discloses use of a plastic seat column which surrounds the metal stand pipe. The seat column is subjected to large amounts of stress, and this is problematic for a plastic seat column design.

The stand pipe is the structural component between the seat and the chair base which absorbs the stress placed on the chair, and has two major functions: 1) to guide and support the smooth, free and accurate movement of the fluid spring, and 2) to protect the fluid spring from breakage and distortion due to the weight and movement of the person occupying the chair, due to high stresses placed on the chair through the fluid spring. The standpipe must withstand the stress due to 400 lbs, at a height of approximately 3 feet.

The commonly used metal stand pipe is typically manufactured as a hollow steel cylinder weighing approximately 1.3 lbs, which is welded to a base at one end. At its other end there is fitted a molded plastic bushing which has a hole reamed in it, with the bushing riveted in place. The steel cylinder is then provided with a chrome-plated or painted finish.

The disadvantages of using a metal stand pipe include the relatively high price of manufacturing, including cutting, grinding and finishing, and the fact that the manufacturing and assembly steps require large amounts of time.

In addition, there is a problem with uniformity in manufacture, since each unit must be accurately processed through the same steps. The overall result is that out of every ten stand pipes, three or four have problems of alignment between the hole at the bottom of the cylinder and the hole in the plastic bushing fitted into the top end. To compensate for this, the hole in the stand pipe bottom is deliberately oversized, to provide the needed tolerance for the piston passing through the stand pipe. This sometimes causes noise or shaking of the fluid springs, detracting from the overall performance.

Therefore, it would be desirable to replace the metal stand pipe with a plastic one, to take advantage of the benefits afforded by use of high-strength plastic engineering materials.

SUMMARY OF THE INVENTION

Accordingly, it is a principal object of the present invention to overcome the disadvantages associated with prior art metal standpipe designs, and provide a plastic stand pipe support for a load-bearing adjustable fluid spring such as is used in furniture design to enable height adjustment of a seat, table, etc.

In accordance with a preferred embodiment of the present invention, there is provided a plastic stand pipe support for a load-bearing adjustable-length fluid spring comprising a plastic cylinder or tubular member of a first length in which the fluid spring is enclosed, inner circumferential walls of the cylinder having formed therein a plurality of ribs extending longitudinally for at least a portion of the first length, an end of each of the ribs shaped as a support projection, a plurality of the support projections contacting the fluid spring cylinder and providing circumferential support therefor while the ribs rigidly support said cylinder, the plurality of support projections comprising a floating support ring for flexibly supporting the fluid spring in circumferential fashion.

In the preferred embodiment, the plastic stand pipe is designed for application to furniture such as a chair, to replace a metal stand pipe supporting a gas spring which allows a seat to be raised and lowered as desired. The plastic stand pipe is attached to the chair base, and encloses the gas spring which supports the seat. A novel structural configuration enables the design to be rigid, while allowing flexibility at its top end.

Use of a strong plastic engineering material is not in itself sufficient in designing the stand pipe to replace the metal stand pipe design. The structural configuration of the stand pipe inner working parts which support the fluid spring must also adapted for use with plastic. The inventive design relies on a combination of structural redesign and use of appropriate plastic engineering materials to achieve the result allowing for replacement of the metal stand pipe.

The structural configuration features a plurality of ribs formed on the inner wall of a hollow plastic cylinder, or tubular member such that the ribs contact the fluid spring cylinder and provide circumferential support. The end of each rib is formed with a support projection which is flexible, and the plurality of support projections form a floating support ring allowing for some freedom in the fluid spring movement from side to side at its top end.

The plastic engineering material comprises fiberglass-reinforced nylon and a ter polymer comprising ethylene, acrylic acid and maleic anhydride, which provide the properties making the compound material sufficiently strong, flexible and durable under the severe mechanical conditions of the application.

The inventive design features a lightweight, plastic standpipe which affords the advantages uniformity of design, reduced manufacturing cost, and ease of assembly. Use of a rigid plastic, molded as a single unit, avoids distortion of the interior of the standpipe. The design of the interior ribs supplies the dual function of guiding the fluid spring with flexibility while providing sufficient rigidity to support loads placed on it.

Other features and advantages of the invention will become apparent from the following drawings and description.

BRIEF DESCRIPTION OF THE DRAWINGS

For a better understanding of the invention with regard to the embodiments thereof, reference is made to the accompanying drawings in which like numerals designate corresponding elements or sections throughout, and in which.

DETAILED DESCRIPTION OF THE PREFERRED EMBODIMENTS

Figure 1:
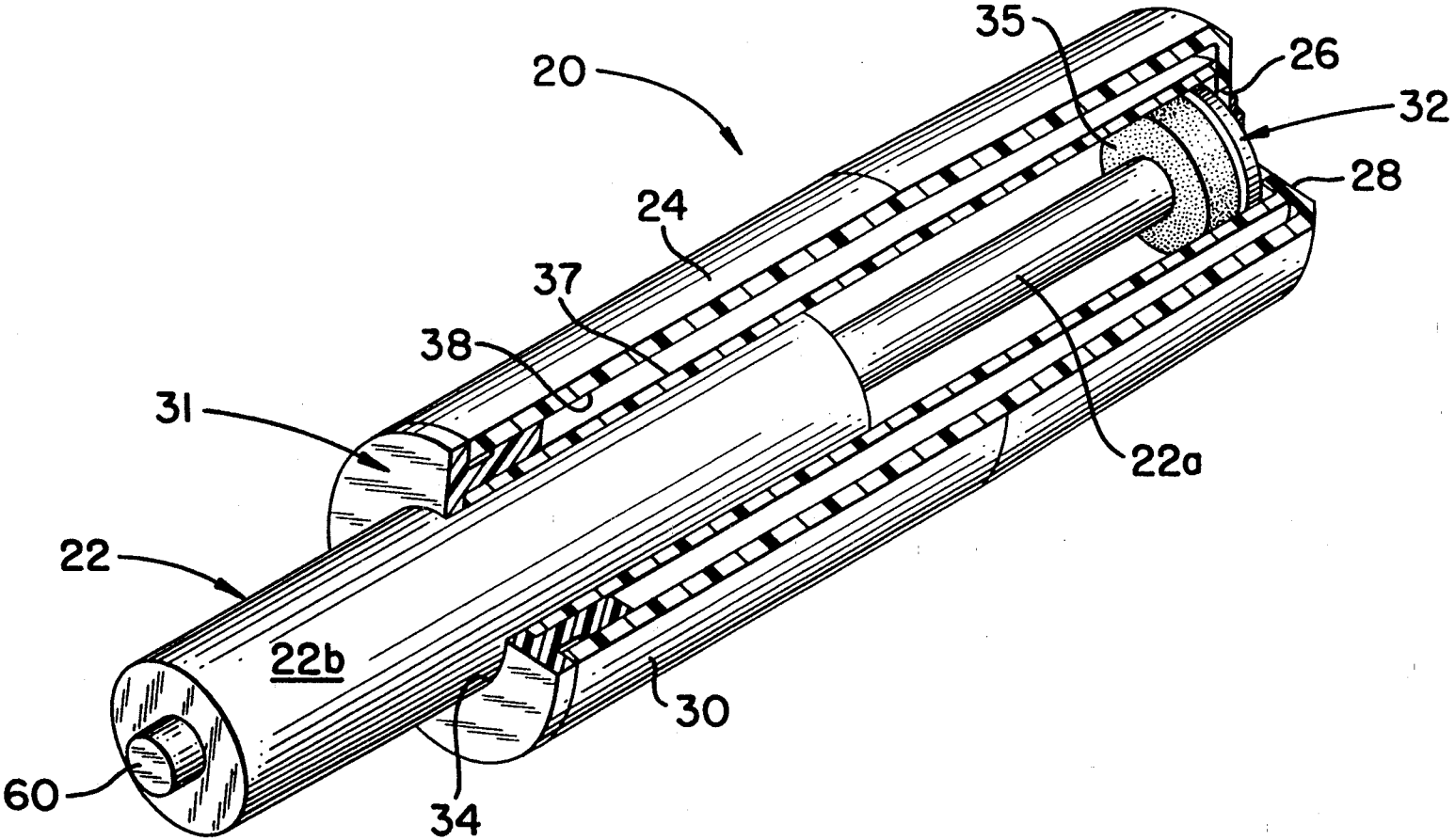
FIG. 1 is a perspective view of a plastic stand pipe support for a load-bearing adjustable-length fluid spring, constructed in accordance with the principles of the present invention.
Figure 2:
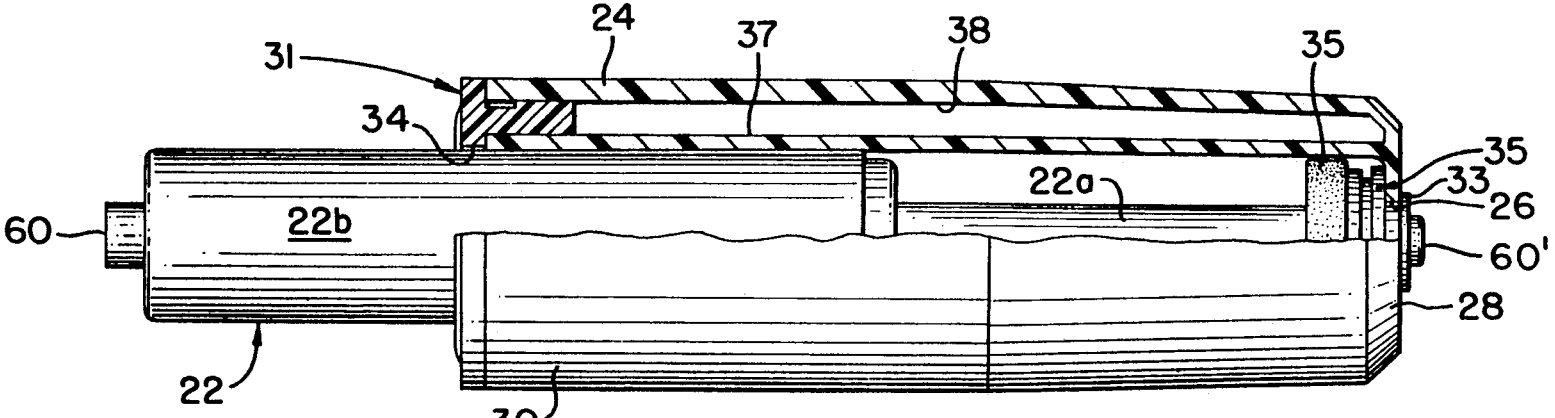
FIG. 2 is a partial cutaway of a side view of the stand pipe of FIG. 1.

Referring now to FIGS. 1-2, there are shown, respectively, a perspective view and a partial cutaway side view of a plastic stand pipe 20 support for a load-bearing, adjustable-length fluid (gas) spring, or column 22, constructed in accordance with the principles of the present invention. Standpipe 20 comprises a hollow plastic cylinder or tubular member 24 having an aperture 26 formed in its bottom end 28 and an open-top end 30 in which an end cap 31 is seated. The lower end of the piston rod **22*a* of the fluid spring or column 22 is anchored by a notatable thrust bearing 32 and end clip 33 at one end, and the cylinder 22*b* passes through a hole 34 formed in end cap 31, so that an adjustable length is achieved. As described in the Background, several prior art designs of fluid spring 22 exist. As disclosed in the prior art designs a valve control pin such as at 60 or 60'** is provided to permit adjustment of the length of the fluid spring in the conventional manner.

In a particular application, stand pipe 20 is designed for application to furniture such as a chair, to replace a metal stand pipe supporting gas spring 22 which allows a seat to be raised and lowered as desired. The plastic stand pipe 20 is inserted at its lower end into the chair base, and encloses fluid spring 22 which supports the seat. As is known in the art, a rubber washer 35 may be mounted on the piston rod **22*a* to provide a resilient stop. As described further herein, a novel structural configuration enables the design to be rigid, while allowing flexibility at its top end 30**.

The plastic cylinder 24 is manufactured of a plastic engineering material specially designed to withstand the stresses placed on it by the load. In the preferred embodiment, the plastic engineering material comprises nylon 6:6 (45-55%) reinforced with fiberglass, together with nylon 6 (15-30%) which provides a low coefficient of friction and high abrasion resistance. In addition, the material contains a ter polymer plastic compound (4-10%) comprising 75% ethylene, 15% acrylic acid, and 10% maleic anhydride, and is reinforced with glass fiber (17-28%). All percentages are by weight. An alternative plastic material replaces the ter polymer compound with a rubber-like polymer (EPM).

Use of a strong plastic engineering material is not in itself sufficient in designing to replace the metal stand pipe and withstand the stress to which it is subjected. In accordance with the principles of the present invention, the structural configuration of the stand pipe 20 inner working parts which support the spring 22 must also be adapted for use with plastic.

Figure 3:
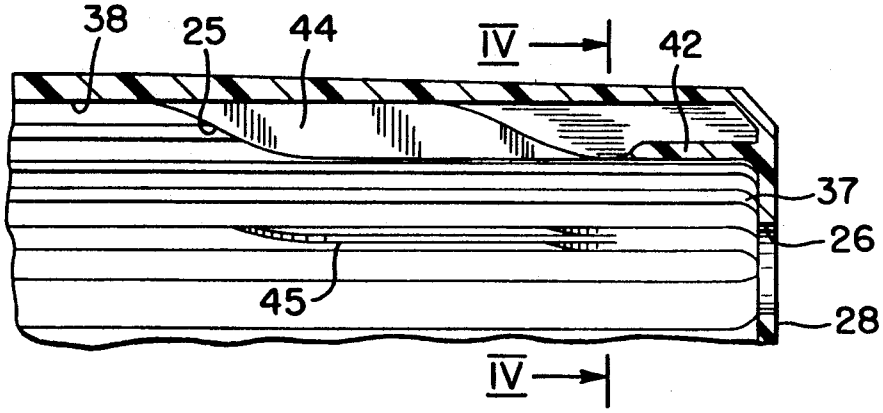
FIG. 3 is a longitudinal cross-section of the stand pipe of FIGS. 1-2.

As shown in FIGS. 1-2 and in the longitudinal cross-section of FIG. 3, the structural configuration of cylinder 24 includes a plurality of longitudinal connecting ribs 37 each integrally formed with the inner wall 38 of cylinder 24 and extending its length. The connecting ribs 37 are integrally formed with cylinder 24 as part of the manufacturing process, to increase the rigidity of cylinder 24 and to insure maximum strength under stress in use, with minimum deformity in shape associated with shrinkage in production.

Each connecting rib 37 has formed therewith an arc-like support member 39, which is integrally formed with a support projection 40 (FIG. 4) shaped to contact cylinder **22*b* and provide it with circumferential support. In accordance with the inventive design, support projections 40 maintain contact with cylinder 22*b* independent of shrinkage in the outer wall of cylinder 24**, and independent of the stress and bending moments to which it is subjected during use.

Typically, plastic cylinder 24 is manufactured by injection molding, and unlike with the prior art metal stand pipe, requires no additional finishing steps for use.

Figure 4:
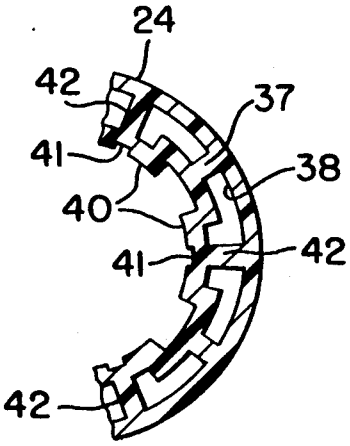
FIG. 4 is a cross-sectional view of the stand pipe taken along section lines IV—IV of FIG. 3.

In FIG. 4, there is shown a cross-sectional view taken along the section lines IV—IV of FIG. 3, showing the longitudinal connecting ribs 37 integrally formed with the interior wall 38 of cylinder 24. Support projections 40 are integrally formed with connecting ribs 37, and are joined by portions 41 one with another near the bottom end 28 of cylindrical member 24, to further increase the strength. In addition to being supported by connecting ribs 37 extending the entire length of cylinder 24, the joined portions 41 are supported by stabilizing ribs 42 extending from interior wall 38. The overall construction is designed to maintain support projections 40 at a constant radial distance from the center of cylinder 24, thus providing circumferential support to fluid spring 22 via a floating support ring.

In the preferred embodiment, as shown in FIG. 3, the width of each stabilizing rib 42 is reduced in dimension over a section 44 of its length, approximately 20–60 mm from its bottom end 28, to become a thinner, stress support rib 45 (FIG. 6), which provides support for fluid spring 22 under certain conditions.

Figure 5:
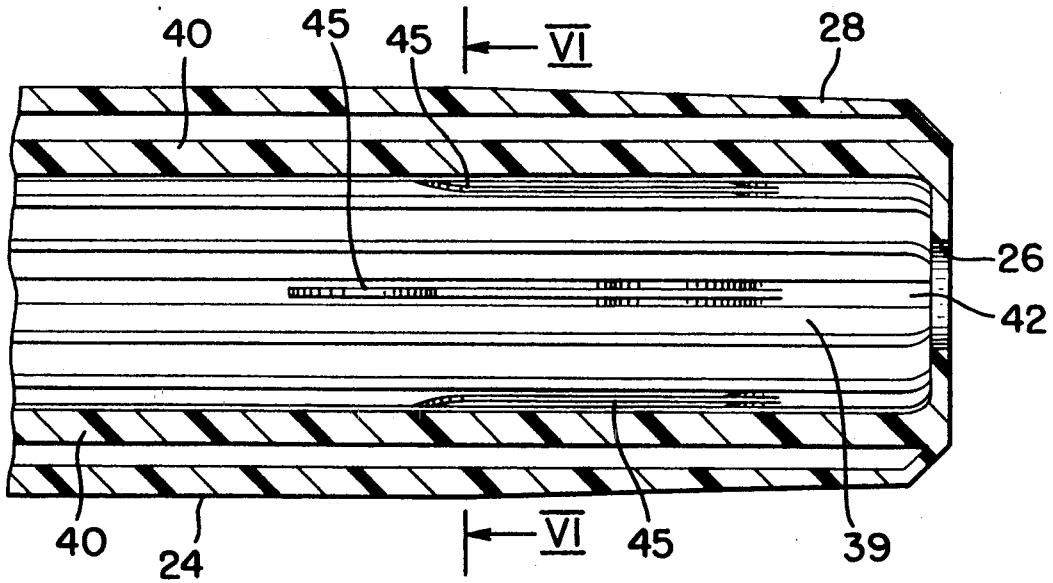
FIG. 5 is a detailed longitudinal cross-section of the stand pipe of FIGS. 1-2.
Figure 6:
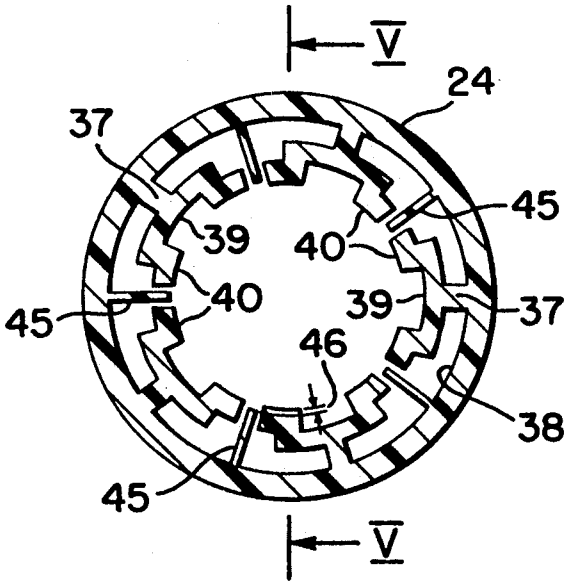
FIG. 6 is a cross-sectional view of the stand pipe taken along section lines VI—VI of FIG. 5.

In FIGS. 5–6 there are shown, respectively, a detailed longitudinal cross-section of stand pipe 20 and a cross-sectional view of stand pipe 20 taken along section lines VI—VI of FIG. 5. As shown in FIG. 6, stress support rib 45 extends from interior wall 38 between support projections 40, which are separated one from the other in this portion of the length of cylinder 24. The end of each stress support rib 45 lies at a radial distance from the center of cylinder 24 which is larger than the radial distance to support projections 40, such that a gap 46 is formed therebetween. Thus, the end of stress support rib 45 is not in constant contact with cylinder **22*b*, but under conditions of severe stress, this contact is established, to provide additional circumferential support to fluid spring cylinder 22*b***.

Figure 8:
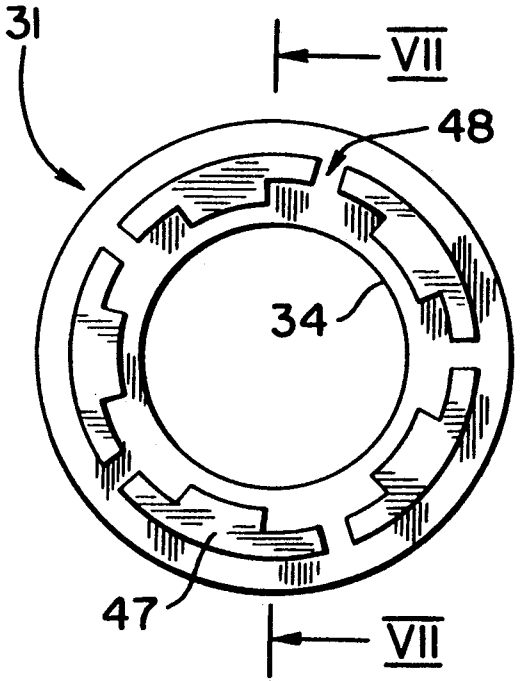
FIGS. 7-8 are, respectively, a side cross-sectional view and an end view of a cap used with the stand pipe of FIGS. 1-2.
Figure 7:
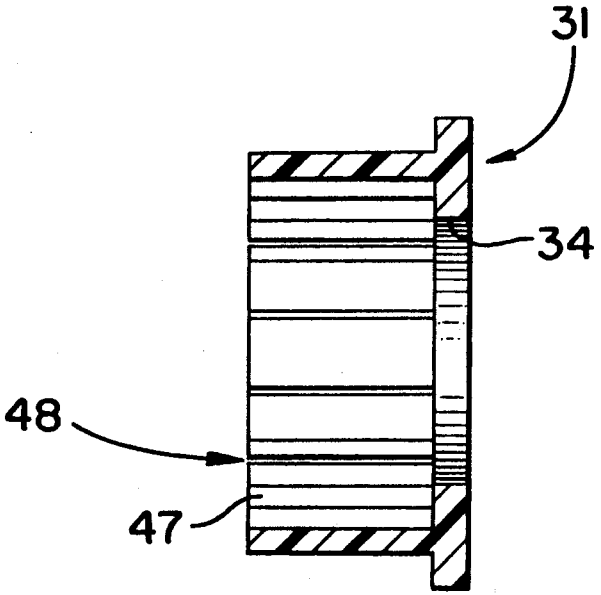

Referring now to FIGS. 7–8, there are shown respectively, a side cross-sectional view and an end view from the underside of end cap 31 used with stand pipe 20. Cap 31 is constructed to provide a cover and engage connecting ribs 37, while loosely supporting ribs 39 and projections 40, by virtue of its oppositely-shaped design, comprising plugs 47 and spaces 48 formed between them. Under stress conditions, plugs 47 provide additional strength for projections 40 without contacting the fluid spring cylinder **22*b* itself. The hole 34 is formed in cap 31 with a size slightly greater than cylinder 22*b***, maintaining the top end flexible.

Figure 9:
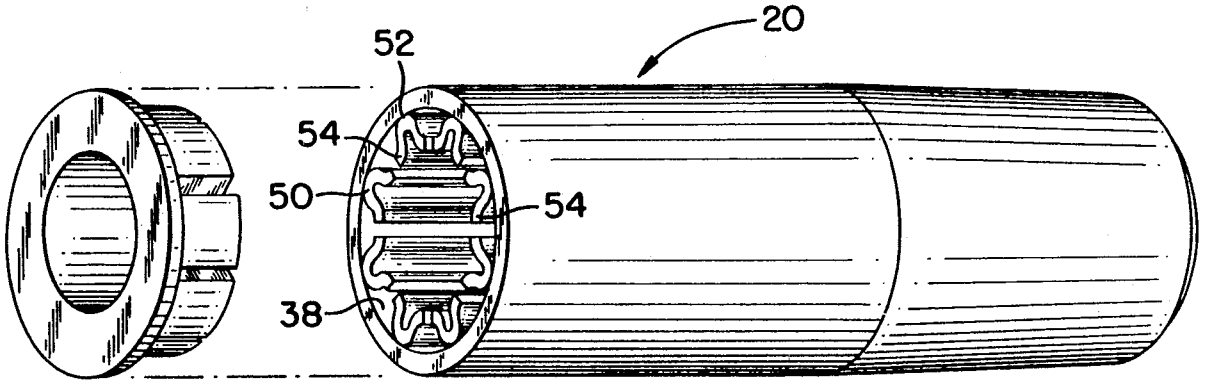
FIG. 9 is a perspective view of an alternative embodiment of the stand pipe of FIG. 1-2.

In FIG. 9 there is shown a perspective view of an alternative embodiment of stand pipe 20, constructed with omega-shaped support ribs 50, each of which itself provides the connecting rib for attachment to interior wall 38 at a point 52 thereon. Support projections 54 are formed at the tips of ribs 50, with spaces between adjacent ones. As before, support ribs 50 provide circumferential support for fluid spring 22 (not shown), and absorb the stresses to which it is subjected. In this embodiment, cap 31 is designed to engage omega-shaped support ribs 50, and support projections 54.

Figure 10:
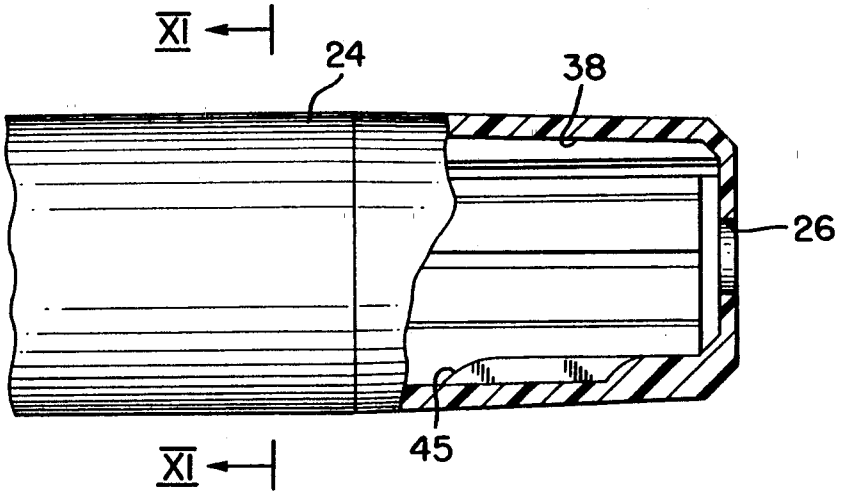
FIG. 10 is a partial cutaway of a side view of the stand pipe of FIG. 9.
Figure 11:
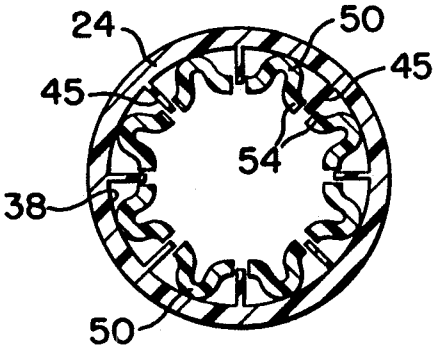
FIG. 11 is a cross-sectional view of the stand pipe, taken along section lines XI—XI of FIG. 10.

In FIG. 10, there is shown a partial cutaway side view, revealing further construction details of the alternative embodiment of stand pipe 20. FIG. 11 is a cross-sectional view of stand pipe 20 taken along section lines XI—XI of FIG. 10. As in the embodiment of FIGS. 1–8, a set of stress support ribs 45 is provided between adjacent support projections 54, providing additional circumferential support to fluid spring 22 under stress.

In summary, the inventive stand pipe design relies on a combination of plastic engineering materials and structural features, such as the ribs and support projections, which provide cylinder 24 with the necessary strength and flexibility to support gas spring 22 in many applications. The design meets the requirements set by ANSI/BIFMA standards for chair and furniture design, contained in standard X51-1985. In addition, the inventive design avoids problems caused by shrinkage after production via injection molding. Variations in the design are possible with regard to the rib design, etc., within these goals.

Having described the invention with regard to certain specific embodiments thereof, it is to be understood that the description is not meant as a limitation since further modifications may now suggest themselves to those skilled in the art, and it is intended to cover such modifications as fall within the scope of the appended claims.

I claim:

1. A plastic stand pipe support for a load-bearing adjustable-length column, comprising:

a generally tubular member having an open end for receipt therethrough of a generally cylindrical adjustable length column means, which column means carries the load of said column, for axial movement relative to said tubular member to adjust the length of said column;

a plurality of circumferentially-spaced radially-extending ribs attached to the inner circumferential wall of said tubular member, said ribs extending axially over at least a portion of the length of said tubular member; and a circumferentially-extending flexible support member at the radially inner end of each of at least a plurality of said ribs, said support members together comprising a floating support ring for circumferentially supporting said cylindrical means while permitting said relative axial movement thereof.

2. The stand pipe support of claim 1, wherein said flexible support members include support surfaces for contacting said cylindrical means, said support surfaces being disposed at a first radial distance from the center of said tubular member.

3. The stand pipe support of claim 2, wherein said first radial distance is maintained substantially constant by said ribs.

4. The stand pipe support of claim 2, further comprising a plurality of circumferentially-spaced stress support ribs attached to said inner circumferential wall and extending radially between said flexible support members, said stress support ribs terminating at a second radial distance from the center of said tubular member, said second radial distance being greater than said first radial distance, whereby the column means contacts said stress support ribs only under conditions wherein said tubular member is subjected to severe stress.

5. The stand pipe support of claim 1, wherein said tubular member, said radially-extending ribs and said flexible support members comprise a unitary molded plastic structure.

6. The stand pipe support of claim 5, wherein said tubular member, said radially-extending ribs and said flexible support members are produced by an injection molding process.

7. The stand pipe support of claim 5, wherein said tubular member is manufactured of plastic comprising at least in part a low-friction material.

8. The stand pipe support of claim 1, wherein each of said flexible support members comprises an arc-like section integrally formed with said rib.

9. The stand pipe support of claim 1, wherein each of said flexible support members comprises an omega-shaped section integrally formed with said rib.

10. The stand pipe support of claim 1, wherein said flexible support members are circumferentially joined together over at least a portion of the length of said tubular member to provide additional stress support.

11. The stand pipe support of claim 1, wherein said tubular member is manufactured of plastic comprising 45%-55% by weight nylon 6:6 reinforced with 17%-28% by weight fiberglass, 15%-30% by weight nylon 6, and 4%-10% by weight of a ter polymer plastic compound, said compound comprising 75% by weight ethylene, 15% by weight acrylic acid, and 10% by weight maleic anhydride.

12. The stand pipe support of claim 1, wherein said tubular member is manufactured of plastic comprising 45%-55% by weight nylon 6:6 reinforced with 17%-28% by weight fiberglass, 15%-30% by weight nylon 6, and 4%-10% by weight of a rubber-like polymer compound.

13. The stand pipe support of claim 1, further comprising an end cap having a opening formed therein through which the generally cylindrical column means passes, said end cap having integrally formed therewith a plurality of circumferentially-spaced plugs extending axially from one side thereof, said end cap being insertable into one end of said tubular member such that said plugs engage radially outer surfaces of said flexible support members to provide additional support, under conditions wherein said cylindrical column means is subjected to severe stress, without contacting the cylindrical column means itself.

14. The stand pipe support of claim 1, wherein said tubular member includes means adjacent the end thereof opposite said open end for mounting said tubular member upright in a base so as to support a surface in adjustable fashion.

15. A plastic stand pipe support for a load-bearing adjustable-length fluid spring, including a pressurized cylinder member and an axially movable piston rod extending therefrom, comprising:

a generally tubular member having an open end for receipt therethrough of the piston rod and cylinder member of said fluid spring;

a plurality of circumferentially-spaced radially-extending ribs formed on the inner circumferential wall of said tubular member, said ribs extending axially from said open end over at least a portion of the axial length of said tubular member;

a circumferentially-extending flexible support member formed on the radially inner end of each of at least a plurality of said ribs and extending axially from said open end over at least a portion of the axial length of said tubular member;

said flexible support members together comprising a floating support ring for circumferentially supporting the cylinder member of said fluid spring for axial movement relative to said stand pipe support; and said tubular member, said radially-extending ribs and said flexible support members comprising an integral molded plastic body.

16. The stand pipe support of claim 15, wherein each flexible support member is generally arcuate in transverse cross section so as to conform generally to the external surface of said cylinder member.

17. The stand pipe support of claim 16, wherein each flexible support member includes a plurality of circumferentially-spaced support projections on the radially inner side thereof for contacting the external surface of said cylinder member.

18. The stand pipe support of claim 17, wherein said support projections comprise an axially extending projection adjacent each circumferential end of the flexible support member, the intermediate portion of the flexible support member extending between said support projections is radially outward of said support projections so as to be free of contact with said cylinder member, and the radially-extending rib on which said flexible support member is formed joins said flexible support member at approximately the midpoint of said intermediate portion.

19. The stand pipe support of claim 15, further comprising a plastic annular end cap for closing said open end of said tubular member, said end cap having an axial opening therein adapted to surround said cylinder member and having a plurality of circumferentially-spaced axially-extending projections formed on one side thereof for receipt between said radially-extending ribs of said tubular member.

20. The stand pipe support of claim 19, wherein said axially-extending projections on said end cap, when received between said radially-extending ribs, engage radially outer surfaces of said flexible support members to provide additional support to said cylinder member.

21. The stand pipe support of claim 15, wherein:

the end of said tubular member opposite said open end comprises an end wall integrally formed with said tubular member; and said end wall is formed with a central opening adapted for connecting the free end of said piston rod to said tubular member.

22. The stand pipe support of claim 15, wherein said radially-extending ribs and said flexible support members extend axially over substantially the full length of said tubular member.

23. The stand pipe support of claim 15, wherein said integral plastic body is manufactured of plastic comprising 45%-55% by weight of nylon 6:6 reinforced with 17%-28% by weight of fiberglass, 6%-15% by weight of nylon 6, and 4%-10% by weight of a polymer selected from the group consisting of a terpolymer plastic compound and a rubber-like polymer.

24. The stand pipe support of claim 15, wherein said integral plastic body is manufactured of plastic comprising at least in part a low-friction material.

25. A load-bearing adjustable-length support column, comprising:

an adjustable-length pressurized fluid spring, including a cylinder member and a piston rod member extending through an end thereof and axially movable relative thereto to vary the length of said support column;

a generally tubular plastic member having an open end for axially receiving said fluid spring;

a plurality of circumferentially-spaced, radially-inwardly extending ribs formed on the inner circumferential wall of said tubular member, said ribs extending axially over at least a portion of the length of said tubular member; and a circumferentially-extending flexible support member formed at the radially inner end of each of at least a plurality of said ribs, said support members contacting the external surface of said cylinder member around the periphery thereof and together comprising a floating support ring for circumferentially supporting said cylinder member.

26. The support column of claim 25, wherein each flexible support member is generally arcuate in transverse cross section so as to conform generally to the external surface of said cylinder member.

27. The support column of claim 26, wherein each flexible support member includes a plurality of circumferentially-spaced support projections on the radially inner side thereof for contacting the external surface of said cylinder member.

28. The support column of claim 27, wherein said support projections comprise an axially extending projection adjacent each circumferential end of the flexible support member, the intermediate portion of the flexible support member extending between said projections is radially outward of said projections so as to be free of contact with said cylinder member, and the radially-extending rib on which said flexible support member is formed joins said flexible support member at approximately the midpoint of said intermediate portion.

29. The support column of claim 25, wherein:

the end of said tubular member opposite said open end comprises an integrally-formed end wall at least partially closing said end;

said fluid spring extends into said tubular member with the free end of said cylinder member extending axially outwardly through said open end thereof and with said piston rod member extending within said tubular member and connected at its free end to said end wall of said tubular body.

30. The support column of claim 29, wherein said tubular member is axially tapered over a portion of the length thereof adjacent to said opposite end thereof for receipt within a mating receptacle carried by a base structure, whereby said support column is adapted to extend vertically between said base structure and a surface to be supported carried by the free end of said cylinder member.

31. The support column of claim 25, wherein said generally tubular member, said radially inwardly extending ribs and said flexible support members comprise an integral molded plastic body.

32. The support column of claim 31, wherein said integral plastic body is manufactured of plastic comprising 45%–55% by weight of nylon 6:6 reinforced with 17%–28% by weight of fiberglass, 6%–15% by weight of nylon 6, and 4%–10% by weight of a polymer selected from the group consisting of a terpolymer plastic compound and a rubber-like polymer.

33. The support column of claim 31, wherein said integral plastic body is manufactured of plastic comprising at least in part a low-friction material.

34. The support column of claim 25, further comprising a plastic annular end cap for closing said open end of said tubular member, said end cap surrounding said cylinder member and having formed on one side thereof circumferentially-spaced axially-extending projections for receipt between said radially extending ribs of said tubular member.

35. The support column of claim 25, wherein said radially-extending ribs and said flexible support members extend axially over substantially the full length of said tubular member.

* * * * *

UNITED STATES PATENT AND TRADEMARK OFFICE

CERTIFICATE OF CORRECTION

PATENT NO. : 5,161,786

DATED : November 10, 1992

INVENTOR(S) : Yoav Cohen

It is certified that error appears in the above-identified patent and that said Letters Patent is hereby corrected as shown below:

On title page, item [56] "8/1991" should read --8/1971--;

Col. 1, line 36, "24,100" should read --24,140--;

Col. 2, line 18, "springs" should read --spring--;

Col. 2, line 59, "also" should read --also be--;

Col. 3, line 65, "notatable" should read --rotatable--;

Col. 7, line 18, "a opening" should read --an opening--;

Col. 8, line 41, "terpolymer" should read --ter polymer--;

Col. 10, line 14, "terpolymer" should read --ter polymer--.

Signed and Sealed this

Sixteenth Day of November, 1993

*Attest:*

Bruce Lehman

BRUCE LEHMAN

*Attesting Officer*

*Commissioner of Patents and Trademarks*